US005091629A

United States Patent [19]

McGee

[11] Patent Number: 5,091,629

[45] Date of Patent: Feb. 25, 1992

[54] HAIR CURLING IRON FOR CREATING AN INWARDLY BENDING CURL AND HEATING APPARATUS THEREFOR

[76] Inventor: Robert J. McGee, 882 Elias, St. Louis, Mo. 63147

[21] Appl. No.: 594,402

[22] Filed: Oct. 9, 1990

[51] Int. Cl.[5] ..... H05B 1/00; A45D 4/12

[52] U.S. Cl. ..... 219/222; 132/118; 132/229; 132/232; 219/225; 219/230; 219/242

[58] Field of Search ..... 219/222-242, 219/230; 132/117, 118, 226, 229, 232, 269

[56] References Cited

U.S. PATENT DOCUMENTS

| | | | |
|---|---|---|---|
| 496,259 | 4/1893 | Hart et al. . | |
| 943,321 | 12/1909 | Shero . | |
| 1,117,021 | 11/1914 | Frey . | |
| 1,329,301 | 1/1920 | Kornstein | 132/117 |
| 1,449,632 | 3/1923 | Talbot | 219/225 |
| 1,809,510 | 6/1931 | Churchill . | |
| 2,400,696 | 5/1946 | Jones | 132/269 |
| 2,484,899 | 10/1949 | Mayo | 219/230 X |
| 3,102,941 | 9/1963 | Pope . | |
| 3,847,166 | 11/1974 | Carr | 219/225 |
| 3,955,064 | 5/1976 | Demetrio et al. . | |
| 4,103,145 | 7/1978 | Oliveri . | |
| 4,298,787 | 11/1981 | Barradas . | |
| 4,479,047 | 10/1984 | Khaja et al. . | |
| 4,520,832 | 6/1985 | Skovdal . | |
| 4,739,151 | 4/1988 | Smal . | |
| 4,740,669 | 4/1988 | Takimae | 219/225 |
| 4,819,674 | 4/1989 | Takimae . | |

FOREIGN PATENT DOCUMENTS

| | | | |
|---|---|---|---|
| 730474 | 3/1966 | Canada . | |
| 2615267 | 10/1977 | Fed. Rep. of Germany | 132/232 |
| 669479 | 8/1929 | France | 219/225 |
| 499904 | 1/1939 | United Kingdom | 219/242 |

*Primary Examiner*—Anthony Bartis
*Attorney, Agent, or Firm*—Robbins & Robbins

[57] ABSTRACT

A hair curling iron and apparatus for heating same are provided. The hair curling iron is comprised of a pair of elongated heat conductive semi-cylindrical tubular barrels having an inner flat surface. The barrels have handles and are pivotally connected together whereby the flat surfaces of the barrels may be brought together enclosing hair between. When closed together, the outer shape of the barrels is round, around which the hair is wound to give a curling effect. The size of the barrels, however, is such that the curling iron can not be readily placed in the heating chamber of a conventional curling iron oven. Thus, the instant invention provides for a heat conducting plate having vertical heat conducting rods to be fixed to the top of the oven in heat transfer relationship therewith. The barrels of the curling iron are hollow and open-ended and fit over the heat-conducting rods whereby the curling iron may be heated.

4 Claims, 1 Drawing Sheet

HAIR CURLING IRON FOR CREATING AN INWARDLY BENDING CURL AND HEATING APPARATUS THEREFOR

BACKGROUND OF THE INVENTION

The present invention relates to hair curling irons and devices for heating them.

There exist in the prior art various hair curling irons to create different effects in curling hair. To enable these irons to impart their curling effect on hair, however, the irons must generally be heated. Many irons have their own heating means, such a those powered by electricity. Others must be heated by external means, such as by heating in an oven. These types, therefore, must be of a specific dimension in order to fit within ovens conventionally employed for curling irons and the like. Irons that do not fit those restrictive dimensions will not fit within the oven and are therefore difficult to heat. Thus, when designing a curling iron, one is usually constrained by size requirements.

Certain types of curls require uniquely shaped and sized curling irons. There is a demand by women for the type of curl that bends, rather than traditionally curls, inward towards the end of the hair. The type of iron for creating this effect has not been adequately designed, perhaps because it would require dimensions too large for conventional hair curling ovens.

Accordingly, there is a distinct need for a hair curling iron that can create the effect of an inward bending curl for the ends of hair, as well as means for heating such an iron.

SUMMARY OF THE INVENTION

By means of the instant invention there has been provided a hair curling iron for creating a curl that bends, rather than traditionally curls, inward towards the end of the hair. Also provided is a means for heating the iron using a supplemental plate attachment to be used in conjunction with conventional hair curling ovens.

The hair curling iron is comprised of a pair of handled semi-cylindrical barrels each having an inner flat longitudinal surface. The barrels are open ended and hollow. The barrels and handles are pivotally connected to each other so that the inner flat longitudinal surfaces oppose each other and may be moved together and apart. The hair is inserted between the flat faces of the barrels and wound around the outside of the barrels.

The device for heating the hair curling iron of the instant invention is comprised of a heat conducting plate having vertical support and heat conducting rods which can be positioned on top of the heating chamber of a curling iron oven. The open barrels of the curling iron of the instant invention are placed over and supported on the rods which impart heat from the oven, thus heating the iron.

It is therefore an object of this invention to provide a curling iron for creating an inward bend to the hair and means for heating the iron using a supplemental plate attachment adapted for use on a conventional curling iron oven.

The above objects are features of this invention. Further objects will appear in the detailed description which follows and will be otherwise apparent to those skilled in the art.

For purpose of illustration of this invention, a preferred embodiment is shown and described hereinbelow in the accompanying drawings. It is to be understood that this is for the purpose of example only and that the invention is not limited thereto.

IN THE DRAWINGS

DESCRIPTION OF THE INVENTION

Figure 1:
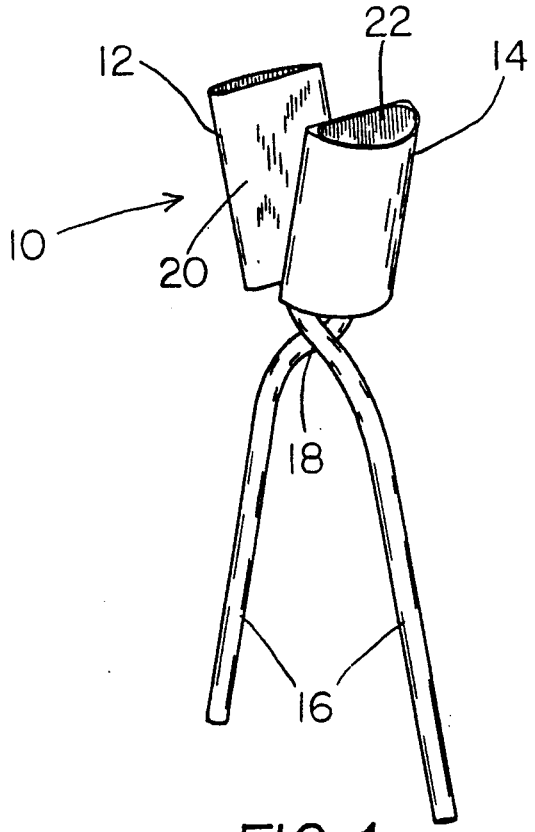
FIG. 1 is a perspective view of the hair curling iron of the instant invention.

The hair curling iron of this invention is generally described by the reference numeral 10 as shown in FIG. 1. It is comprised of a pair of metal semi-cylindrical barrels 12 and 14 each having a handle 16. The handles are pivotally connected to each other at 18 so that by manipulating handles 16, barrels 12 and 14 may be moved together or apart in relation to each other. Barrels 12 and 14 are identical in dimension, each being half-moon shaped in cross section and each has a flat inner longitudinal surface 20. When barrels 12 and 14 are brought in contact with each other in a closed condition, the outer shape of curling iron 10 is fully cylindrical. The barrels are hollow and each have open end 22 opposite the handle 14.

Figure 2:
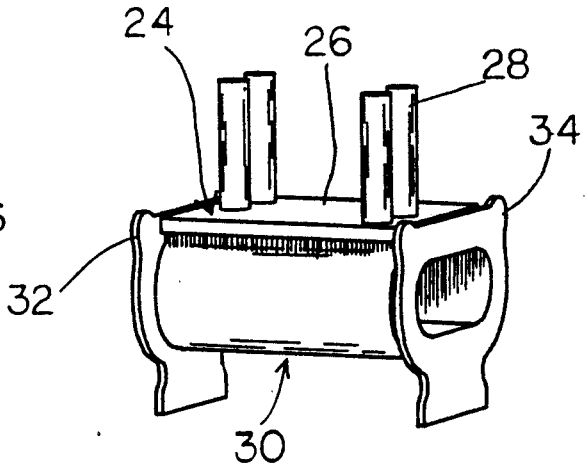
FIG. 2 is a perspective view of the heating plate attachment of the instant invention as used on a conventional curling iron oven.

The heating plate attachment for heating curling iron 10 is generally indicated by the reference numeral 24 as shown in FIG. 2. It is comprised of a metal plate 26 and plurality of vertical metal rods 28 which are supported by plate 26. Metal plate 26 is dimensioned so that it rests on top of a conventional curling iron oven 30 between raised flanges 32 and 34. Rods 28 have a length substantially the same as the length of barrels 12 and 14 and have a diameter less than the inner dimensions of the barrels. Although two pairs of rods 28 are shown and more pairs may be employed, it is to be understood that only one pair is needed for heating the curling iron 10.

Figure 3:
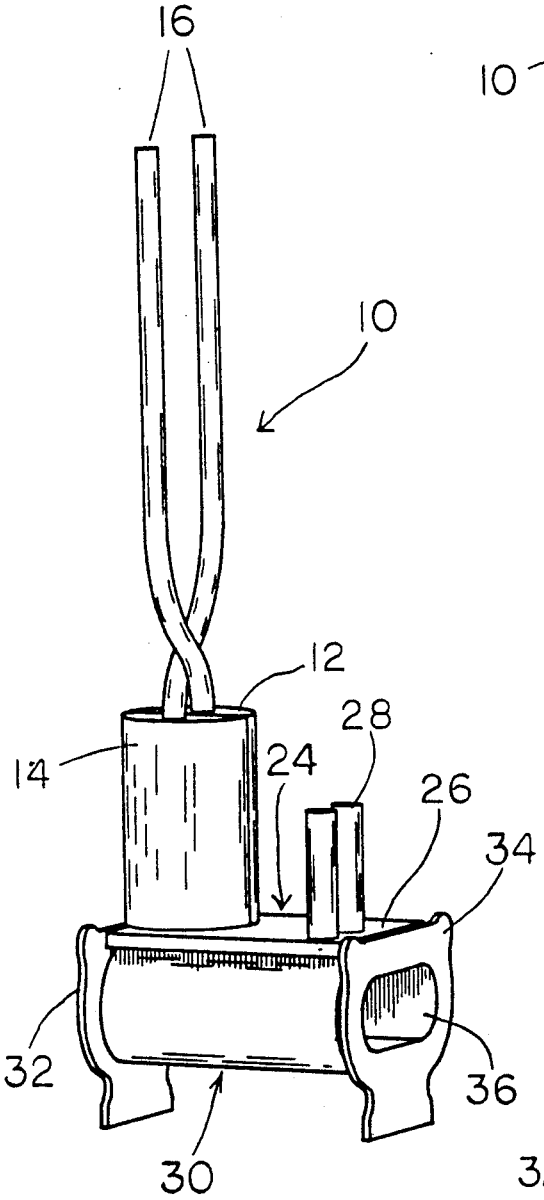
FIG. 3 is a perspective view of the curling iron and heating plate attachment as used on a conventional curling iron oven.

The rods of pair 28 are spaced in close alignment to each other for receiving the hollow barrel each of curling iron 10 through open ends 22 as shown in FIG. 3. The closed barrels of iron 10 are too large to fit within oven chamber 36. Therefore, they must be heated up by conduction of the radiating heat from oven chamber 36 through plate 26 and vertical rods 28. Barrels 12 and 14, which are in close proximity to rods 28 during heating on plate attachment 24, receive the radiant heat. Using a conventional curling iron oven, heating of iron 10 to a temperature sufficient for curling hair takes about 60–90 seconds.

In use of curling iron 10 after it is heated on plate attachment 24, barrels 12 and 14 are separated to receive a portion of a length of hair between the flat inner surfaces 20. The barrels are closed together over the portion of hair forming a cylindrical outer surface around which the remaining length of hair is wound, as conventionally done with curling irons. After an appropriate length of time, the curling iron is removed, leaving an inward bend at the area of hair that was pressed between barrels 12 and 14.

Various changes and modifications may be made within this invention as will be apparent to those skilled in the art. Such changes and modifications are within the scope and teaching of this invention as defined in the claims appended hereto.

What is claimed is:

1. A hair curling iron comprising a pair of elongated semi-cylindrical barrels of heat conductive material each having an inner flat longitudinal surface facing the inner flat longitudinal surface of the other barrel, said barrels each having a handle at an end thereof and being pivotally connected, whereby said barrels may be moved apart and together in relation to each other, said inner flat longitudinal surfaces of said barrels meeting when said barrels are pivotally moved together, said barrels further being hollow for a substantial distance along a longitudinal length of said barrels and having an open end opposite said end having said handle, said open end being of sufficient dimension to receive in removable relationship therein a heating element, whereby said curling iron may be heated prior to use.

2. The hair curling iron of claim 1 in which said barrels have an arcuate outer surface opposite said inner flat longitudinal surface.

3. A combination hair curling iron and heating plate arrangement therefore, said hair curling iron comprising a pair of elongated semi-cylindrical barrels of heat conductive material each having an inner flat longitudinal surface facing the inner flat longitudinal surface of the other barrel, said barrels each having a handle at an end thereof and being pivotally connected, whereby said barrels may be moved apart and together in relation to each other, said inner flat longitudinal surfaces of said barrels meeting when said barrels are pivotally moved together, said barrels further being hollow for a substantial distance along a longitudinal length of said barrels and having an open end opposite said end having said handle, said heating plate arrangement comprising a curling iron oven having a heating chamber for receiving curling irons to be heated and a plate, said plate being heat conducting and positioned on top of said hair curling iron oven so as to receive heat therefrom, said plate supporting a plurality of vertical heat conducting rods, said hollow open-ended barrels being of sufficient dimension to receive in removable relationship said heat conducting rods of said plate, said barrels being adapted to be placed over said rods whereby heat from said oven is conducted to said plate and rods and further transmitted to each of said barrels, whereby said curling iron may be heated prior to use.

4. A device for heating a hair curling iron having at least one hollow barrel and having a dimension greater than can be received within a heating chamber of a hair curling iron oven, said device comprising a curling iron oven having a heating chamber for receiving and heating a curling iron and a heat conductive plate, said plate being mounted on a top surface of said curling iron oven in heat exchange relationship for receiving heat therefrom, said top of said oven having opposed upstanding flanges at the edges thereof whereby said plate closely interfits between said flanges to provide a secure seating relationship, said plate supporting a plurality of vertical heat conducting rods, said rods being adapted to receive a hollow barrel of a hair curling iron larger than capable of being received in the oven chamber, whereby heat from the oven is conducted to said plate and said rods and is further transmitted to the curling iron.

* * * * *